US007334389B1

(12) United States Patent
Allen

(10) Patent No.: US 7,334,389 B1
(45) Date of Patent: Feb. 26, 2008

(54) AFTERBURNER IGNITER

(75) Inventor: John G Allen, Bristol (GB)

(73) Assignee: Rolls-Royce plc, London (GB)

( * ) Notice: Subject to any disclaimer, the term of this patent is extended or adjusted under 35 U.S.C. 154(b) by 2660 days.

(21) Appl. No.: 08/943,478

(22) Filed: Oct. 22, 1997

(30) Foreign Application Priority Data

Nov. 7, 1996 (GB) ..... 9623196.4

(51) Int. Cl.
*F02C 7/22* (2006.01)

(52) U.S. Cl. ..... 60/39.094; 60/761; 60/223

(58) Field of Classification Search ..... 60/39.094, 60/261, 740, 223; 239/104, 115–118, 123, 239/533.2, 533.12
See application file for complete search history.

(56) References Cited

U.S. PATENT DOCUMENTS 887,302 A * 5/1908 Barnes ..... 239/117
3,800,530 A * 4/1974 Nash ..... 60/261
4,223,838 A * 9/1980 Maria-Vittorio-Torrisi .. 239/123
4,229,944 A * 10/1980 Weiler ..... 60/740
4,570,853 A * 2/1986 Schmied ..... 239/116
5,119,991 A * 6/1992 Divers ..... 239/117
5,269,137 A * 12/1993 Edwards, III ..... 60/261
5,297,391 A * 3/1994 Roche ..... 60/261
5,315,822 A * 5/1994 Edwards, III ..... 60/261

FOREIGN PATENT DOCUMENTS

GB 2105837 3/1983

* cited by examiner

*Primary Examiner*—Michael J. Carone
(74) *Attorney, Agent, or Firm*—Oliff & Berridge, PLC

(57) ABSTRACT

A gas turbine engine afterburner igniter is provided with primary fuel duct means for injecting a jet of fuel into a gas stream directed into a combustion chamber. A spring is positioned within the bore of said fuel duct. The spring being moveable relative to said duct such that during operation said spring moves downstream though the bore due to the passage of fuel therein and returns to it's original position thereafter. During operation the spring abrades the internal surface of the bore thus removing carbon deposits.

6 Claims, 3 Drawing Sheets

AFTERBURNER IGNITER

BACKGROUND OF THE INVENTION

1. Field of the Invention

This invention relates to gas turbine engines. More particularly but not exclusively this invention relates to a gas turbine engine afterburner.

2. Description of Related Art

Afterburning is a method of augmenting the basic thrust of a gas turbine engine to improve aircraft take-off, climb and in the specific case of military aircraft, combat performance. Additional fuel is introduced and burned between the turbine section of the engine and the jet pipe propelling nozzle utilising unburned oxygen in the exhaust gas to support combustion. The resulting increase in the temperature of the exhaust gas gives an increased velocity to the jet leaving the jet pipe nozzle and therefore increases the engine thrust.

Although the gas temperature in the jet pipe is extremely hot the afterburner cannot be relied upon to ignite spontaneously. Some form of ignition has to be provided, therefore, for reliable operation.

In hot-shot ignition a jet of fuel is injected into the combustion chamber outlet. The resulting hot streak of flame extends through the turbine into the jet pipe where it ignites the afterburner fuel fed into the jet pipe. This form of afterburner ignition necessitates the use of at least one fuel injector at least the tip of which extends into the combustion chamber.

A problem arising with the use of hot shot ignition is that carbon debris left by burnt or boiling fuel in the injector rapidly builds up. This debris has to be removed otherwise the injector becomes blocked and ceases to function. Regular examination and frequent preventative maintenance of the injectors is thus required. Unless the injectors are easily accessed and removed this could mean the aircraft has to be taken out of service.

It is believed that the generation of carbon debris is temperature related and its build-up occurs in the injectors delivery passage lying in the space between the combustion chamber outer casing and the wall of the combustion chamber where the temperature may be of the order of 130° C. which is considerably less than the temperature of for example the area in which the combustion chamber where the nozzle is positioned and which temperature may be of the order of 1,300° C. The temperature gradient along the injector delivery passage has been found to be very steep and it is believed that this may be a primary cause of carbon debris build up. It is also believed that control of the thermal gradient as by ducting air over the injector or even by applying some form of thermal lagging to the body of the injector is likely to greatly retard the build up of such debris.

SUMMARY OF THE INVENTION

It is an object of the present invention to provide apparatus which at least partially removes the build up of carbon debris in the fuel delivery passage of the injector of an afterburner hot-shot ignition unit thereby considerably extending injector examination and cleaning intervals and to provide improvements generally.

According to the present invention there is provided a gas turbine engine afterburner igniter comprising fuel duct means for injecting a jet of fuel into a gas stream directed into a combustion chamber characterised in that moveable resilient means is provided within said fuel duct means such that during operation said resilient means moves relative to said duct means due to the passage of fuel within said fuel duct so as to abrade at least some of the internal surface of the bore of said duct.

BRIEF DESCRIPTION OF THE DRAWINGS

The invention will now be described with reference to the accompanying drawings in which.

DETAILED DESCRIPTION OF PREFERRED EMBODIMENTS

Figure 1:
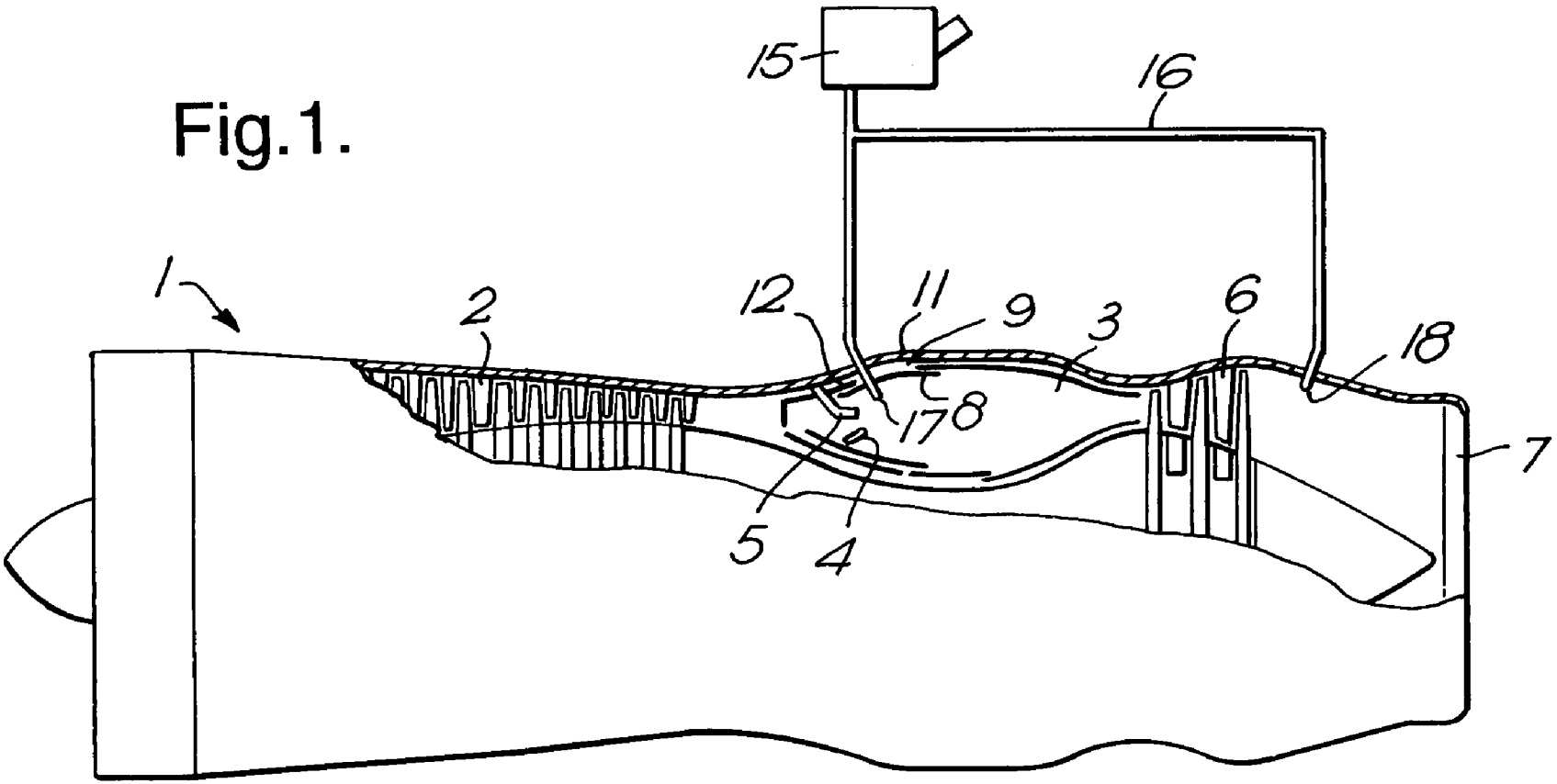
FIG. 1 is a schematic form of an axial gas turbine engine partly in section and including a combustion chamber and part of the turbine and exhaust jet pipe, together with a hot-shot fuel ignition apparatus.

As shown in FIG. 1 a gas turbine engine 1 includes a compressor indicated generally at 2, a combustion chamber 3 with an igniter plug 4 and a conventional fuel spray apparatus 5 for spraying fuel into a stream of compressed air from the compressor, a turbine 6 and a jet pipe 7. The combustion chamber is defined by a wall 8 outside which is an outer casing 9 and an enclosing wall 11, the wall 8 and casing 9 together forming a duct 12 through which compressed air is channelled so as to provide a stream of cooling air to pass over the wall 8 and into the combustion chamber through apertures in the wall 8.

The mixture of compressed air and fuel is ignited by the plug 4 and the resulting expanded and burnt gas is directed through the turbine and into the jet pipe 7 to provide propulsive force.

In order to increase the propulsive force an afterburning apparatus is provided. This apparatus may take a variety of forms, one such being known as hot shot ignition which includes a hot shot unit coupled to a fuel supply (not shown) for pumping fuel through a pipe to an injector 17 which protrudes into the combustion chamber and to a spray nozzle 18 located in the jet pipe 7.

Figure 2:
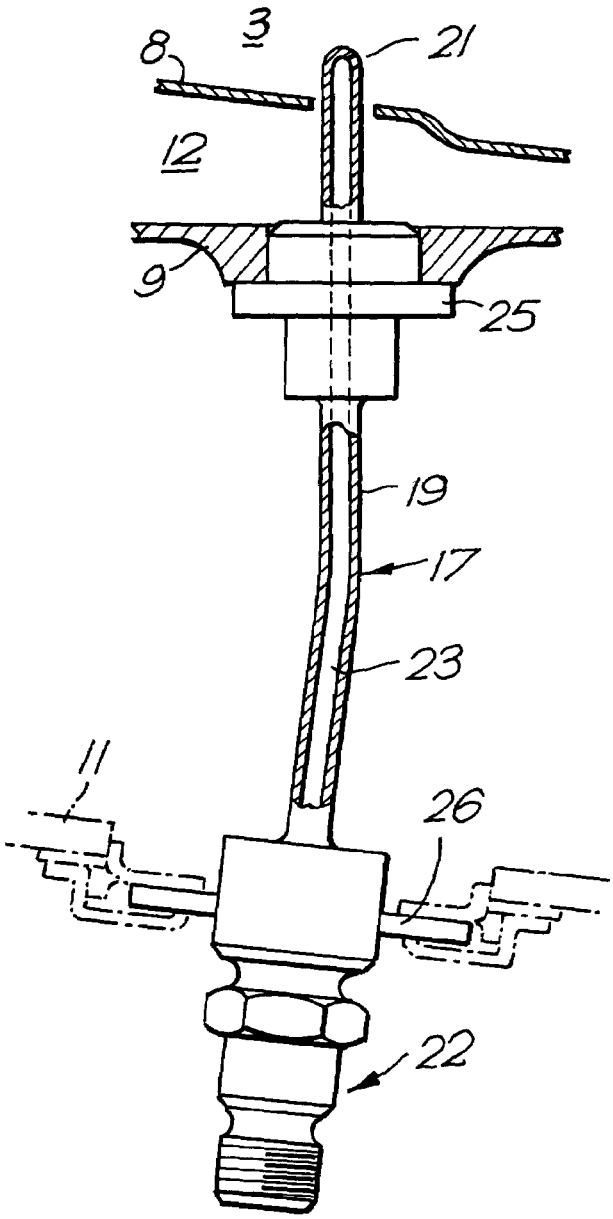
FIG. 2 is a part cross section through the injector of the hot-shot fuel ignition apparatus of FIG. 1.

The injector as shown in greater detail in FIG. 2 comprises a tubular body 19 having a nozzle 21 at one end and a screw coupling 22 at the other for making connection with the fuel output of the hot shot unit 15. A passage 23 extends through the tubular body 19. A mounting flange 25 extends through the tubular body 19. The mounting flange 25 on the body 19 adjacent the nozzle 21 enables the injector to be secured to the outer casing 9 of the combustion chamber with the nozzle 21 protruding into the combustion chamber. Another mounting flange 26 is located on the body 19 adjacent the screw coupling 22 to enable the body to be secured to the enclosing wall 11.

In operation the hot shot unit 15 pumps fuel to both nozzles 18 and 21. Fuel is expelled from nozzle 21 as the stream which is ignited during its passage through the combustion chamber, the flaming stream passing through the turbine 6 as a hot streak of flame and so into the jet pipe 7 where it ignites the fuel being sprayed into the nozzle 18. Upon combustion of the spray fuel the temperature of the exhaust gas already flowing through the jet pipe increases and the expanding gases accelerate through the pipes to provide the required additional thrust.

The passage 23 in the injector 17 is liable to become blocked by carbon debris deposited by the fuel in the passage due to the temperature in the passage and as a consequence it is necessary to remove the injector for clearing at regular intervals.

Figure 3:
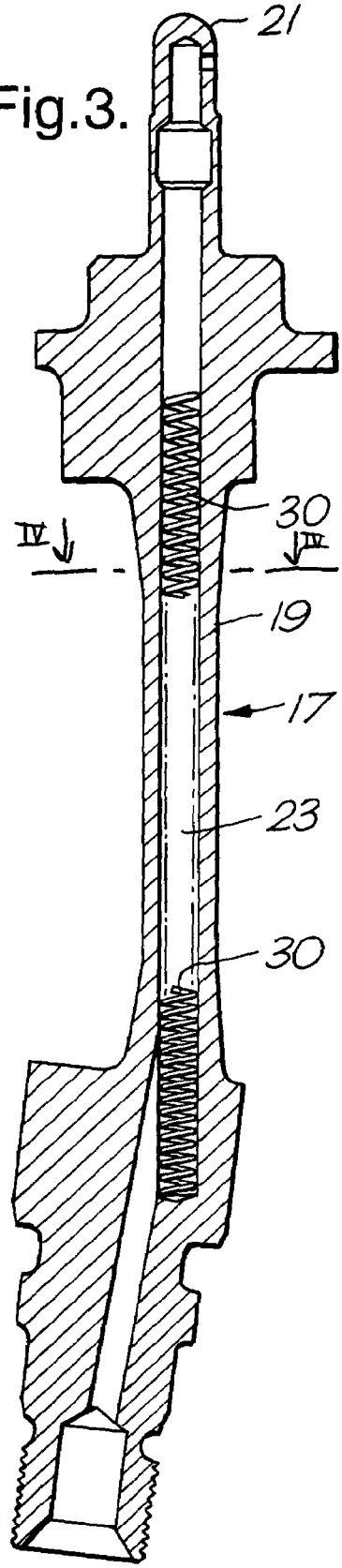
FIG. 3 is a part cross section through an injector in accordance with the present invention.

Referring to FIG. 3 a spring 30 is housed within injector body 19. The spring 30 is of shorter length than the straight length of bore 23 and the spring rate is selected so that fuel pressure of up to 870 psi will produce initial compression flexing. In certain engines the fuel injector 17 is positioned in the base of the engine and points upwards so that the input to the ejection point of the fuel is at the lowest point. As fuel passes down through bore 23 containing spring 30, the spring 30 moves longitudinally relative to the injector body 19, in the direction of the fuel. The pressure drop along the spring caused by the passage of the fuel pushes spring 30 back up the bore thus effectively scouring the inner surfaces of bore 23 and thus removing carbon. When the fuel flow ceases spring 30 drops back to the upstream end of the tube since the injector is mounted in the bottom of the combustion chamber.

The spring 30 and internal surfaces of bore 23 are coated with a low friction material which is resistant to attack by sulphur and other substances in the fuel.

Figure 4:
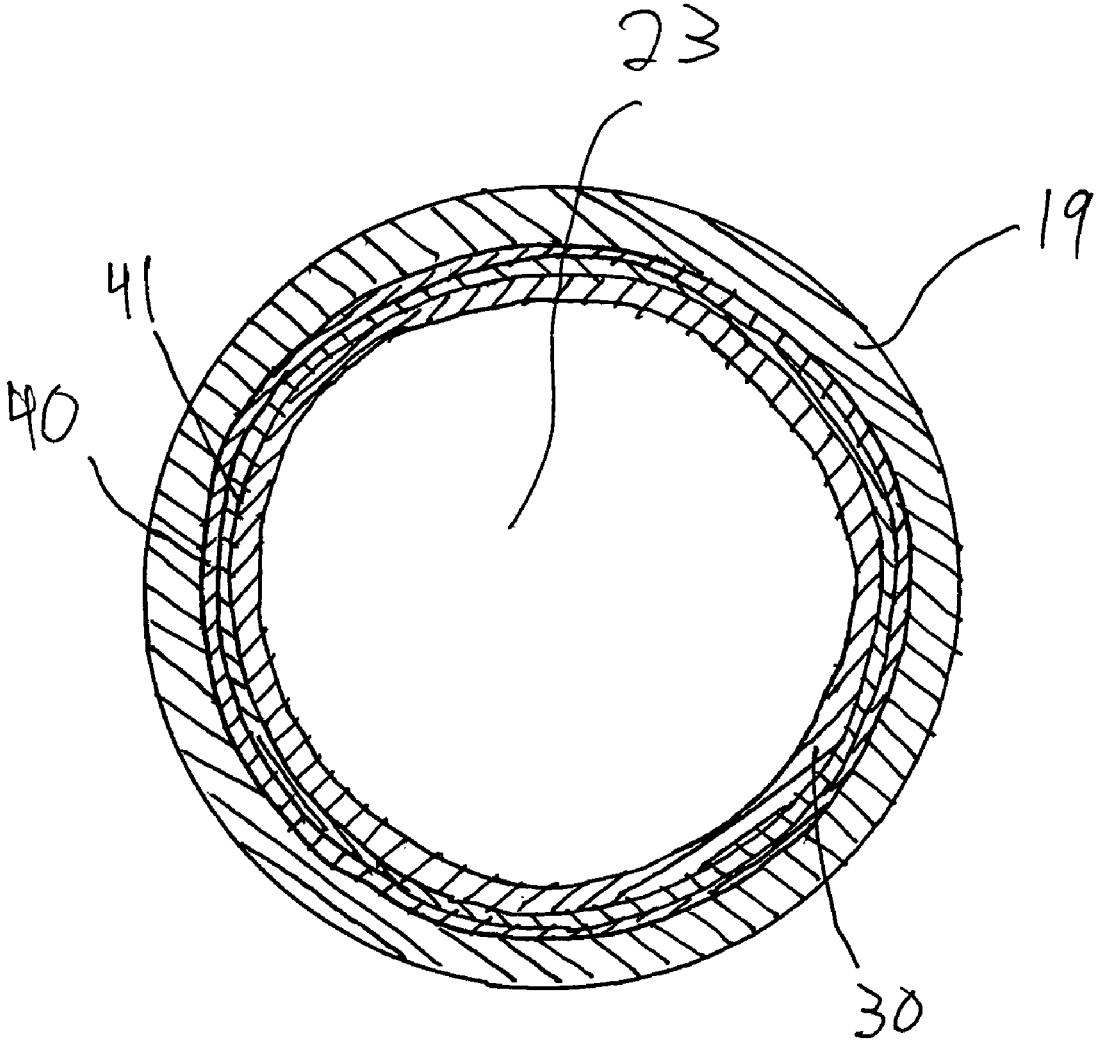
FIG. 4 is a cross section through IV-IV of FIG. 3.

FIG. 4 shows a cross section of the bore 23, spring 30, and injector body 19. The injector body 19 is coated with a low friction material 40, and the spring 30 is coated with a low friction material 41.

Movement of the spring in the aforementioned manner serves to remove carbon deposits within the bore 23 of injector 17.

The invention claimed is:

1. A gas turbine engine afterburner igniter comprising a fuel duct for injecting a jet of fuel into a gas stream directed into a combustion chamber characterised in that a moveable resilient means is provided within said fuel duct such that during operation said moveable resilient means moves relative to said fuel duct due to passage of fuel within said fuel duct so as to abrade at least some of an internal surface of a bore of said duct.

2. A gas turbine engine afterburner igniter as claimed in claim 1 characterised in that said moveable resilient means is a spring.

3. A gas turbine engine afterburner igniter as claimed in claim 2 characterised in that said spring has a length that is shorter than a length of the bore of said fuel duct.

4. A gas turbine engine afterburner igniter as claimed in claim 1 characterised in that movement of said moveable resilient means relative to said duct, is in one direction dependent upon the passage of fuel flow through said bore and movement relative to said duct in another direction is dependent upon gravity.

5. A gas turbine engine afterburner igniter as claimed in claim 2 characterised in that said spring is provided with a low friction coating.

6. A gas turbine engine afterburner igniter as claimed in claim 1 characterised in that the internal surface of said bore of said fuel duct is provided with a low friction coating.

* * * * *